US005701946A

United States Patent [19]

Rommel et al.

[11] Patent Number: 5,701,946

[45] Date of Patent: Dec. 30, 1997

[54] APPARATUS FOR SHOOTING FOUNDRY CORES OR MOLDS

[75] Inventors: Reiner Rommel, Brühl, Germany; Ulf Stangler, Ketsch, Germany

[73] Assignee: Adolf Hottinger Maschinenbau GmbH, Mannheim, Germany

[21] Appl. No.: 656,233

[22] PCT Filed: Jun. 17, 1994

[86] PCT No.: PCT/DE94/00690

§ 371 Date: Jun. 11, 1996

§ 102(e) Date: Jun. 11, 1996

[87] PCT Pub. No.: WO95/15826

PCT Pub. Date: Jun. 15, 1995

[30] Foreign Application Priority Data

Dec. 11, 1993 [DE] Germany ..... 43 42 364.7

[51] Int. Cl.[6] ..... B22C 11/04; B22C 13/12; B22C 15/26

[52] U.S. Cl. ..... 164/201; 164/186

[58] Field of Search ..... 164/200, 201, 164/202, 186, 169, 19, 20, 21, 22

[56] References Cited

U.S. PATENT DOCUMENTS

| | | | |
|---|---|---|---|
| 4,969,503 | 11/1990 | De Foronda | 164/169 |
| 5,024,161 | 6/1991 | Fischer et al. | 164/169 |

FOREIGN PATENT DOCUMENTS

| | | | |
|---|---|---|---|
| 0 327 825 | 8/1989 | European Pat. Off. . | |
| 0 357 871 | 3/1990 | European Pat. Off. . | |
| 34 22 687 | 6/1985 | Germany . | |
| 320426 | 5/1957 | Switzerland . | |
| 2045660 | 11/1980 | United Kingdom | 164/169 |

*Primary Examiner*—J. Reed Batten, Jr.

*Attorney, Agent, or Firm*—Bell Seltzer Intellectual Property Law Group of Alston & Bird LLP

[57] ABSTRACT

An apparatus for shooting foundry cores or molds with a shooting arrangement (1), a set of tools comprising an upper tool (6) and a lower tool (7), and a tool change mechanism (8) rotatable about a vertical axis (10) and comprising two tool change frames (9), each of the tool change frames (9) being adapted for alternate rotation into and out of the shooting arrangement (1), is designed and constructed for optimal exploitation or utilization such that the tool change frame (9) rotated into the shooting arrangement (1) serves to receive the lower tool (7) carrying the cores (11), and that the lower tool (7) carrying the cores (11) is rotatable out of the shooting arrangement (11) and at the same time the other tool change frame (9) can be rotated into the shooting arrangement (1) with a preferably cleaned lower tool (7).

7 Claims, 1 Drawing Sheet

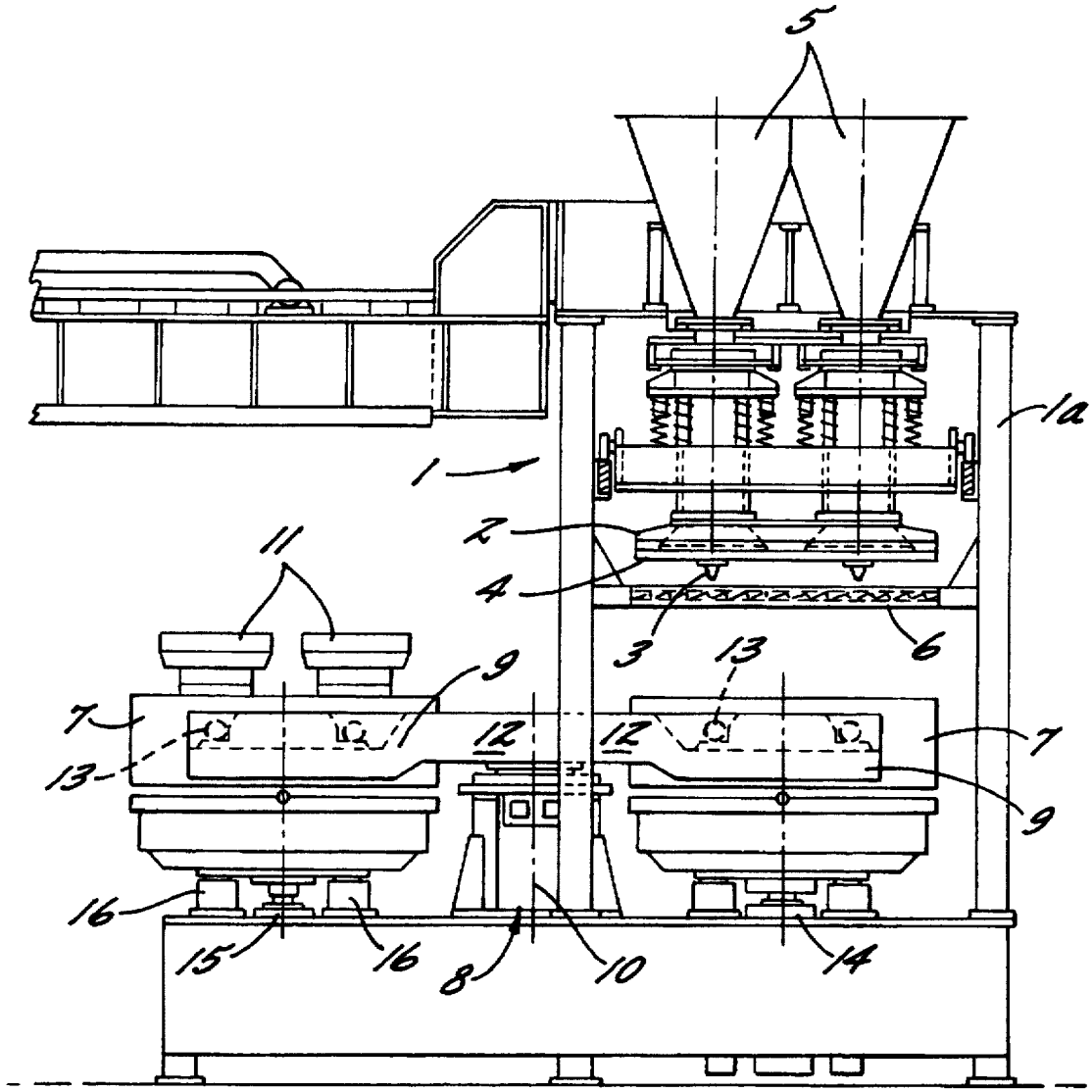
5
1a
1
2
4
3
6
11
9
13
7
12
12
13
7
9
16
15
16
8
10
14

APPARATUS FOR SHOOTING FOUNDRY CORES OR MOLDS

BACKGROUND OF THE INVENTION

The invention relates to an apparatus for shooting foundry cores or molds with a shooting arrangement, a set of tools comprising an upper tool and a lower tool, and a tool change mechanism rotatable about a vertical axis and comprising two tool changing frames, each rotatable frame being adapted for alternate movement into and out of the shooting arrangement.

In the foundry practice, core shooting machines have been known for many years. For casting molded products, foundry cores or molds are in most cases made as separate parts, combined, and joined together to form a casting mold. An essential component of the core shooting machine is the so-called shooting head with shooting plates accommodating the shooting nozzles. Molding material, in particular core sand, i.e. a quartz sand previously compounded or coated with binding agents is supplied to the shooting heads under discussion, from which it is blown or shot under a very high air pressure into the respective molds through the nozzles arranged in the shooting plate.

Known from DE 34 22 687 is an apparatus for shooting foundry cores or molds of the described kind, the apparatus being provided likewise with a tool change mechanism rotatable about a vertical axis and having two tool change frames. The tool change mechanism provided in the prior art apparatus serves to change an entire set of tools, i.e., to change both the upper tool and the lower tool. Shot cores need to be ejected or removed before a tool change. However, should it be desired that shot cores be combined with any loose parts whatsoever, or that loose parts be even introduced into the core being shot, the known apparatus will not be suitable for shooting foundry cores or molds. Primarily, when loose parts are handled by hand together with the finished cores, the known apparatus will permit only an unsatisfactory throughput.

It is therefore the object of the invention to improve and further develop an apparatus of the initially described kind, so as to realize an optimal exploitation or utilization, even when shot cores are combined with loose parts that are to be inserted, for example, by hand.

SUMMARY OF THE INVENTION

The above and other objects and advantages of the present invention arte achieved by the provision of an apparatus which comprises a core shooting arrangement which includes a support frame. A shooting head is mounted on the support frame, and an upper tool is mounted on the support frame below the shooting head. At least one lower tool is provided, and a tool change mechanism supports the one lower tool and moves the same between an operative position located below the upper tool and a withdrawn position. The tool change mechanism is rotatable about a vertical axis and includes two diametrically opposed tool change frames, such that the two change frames may be alternately moved horizontally between the operative and withdrawn position. A lifting table is mounted to the support frame below the operative position of the tool change mechanism and is configured for lifting the one lower tool from the mechanism and moving the same upwarding against the upper tool to form a mold which may then be filled by the shooting head. When the lifting table is lowered, the lower tool and the resulting molded core are separated from the upper tool and the lower tool is repositioned upon the mechanism, and the mechanism is then able to move the lower tool and molded core to the withdrawn position where the molded core may be removed from the lower tool.

In accordance with the invention it has been recognized, first of all, that the tool change mechanism known per se can be used in ideal manner to adapt cycle times within the core shooting arrangement to corresponding processing times outside the core shooting arrangement, the tool change frame rotated into the shooting arrangement serving only to receive the lower tool carrying the cores. Essential is that now the lower tool carrying the cores can be rotated by means of the tool change mechanism out of the shooting arrangement, and that simultaneously the other tool change frame with a preferably cleaned lower tool can be rotated into the shooting arrangement. Consequently, it is possible, on the one hand, to remove the cores that have been rotated out, and manually combine same, if need be, with any loose parts whatsoever and, on the other hand, to then clean the lower tool freed from the cores, or to insert therein any loose parts for a combination with cores being shot. Subsequently, the cleaned lower tool is again rotated into the shooting arrangement, while the lower tool carrying the shot cores is simultaneously rotated out of the shooting arrangement. This operation may be repeated as often as desired.

As regards a specific configuration of the tool change mechanism, it will be of advantage, that the tool change frames are arranged on arms extending on both sides from the axis of rotation and being preferably diametrically opposed. These arms could be exactly opposite, i.e., in alignment with one another. However, likewise possible is an angled arrangement of the arms and, thus, of the tool change frames. In this connection, special consideration need to be directed to the spatial layout of the shooting arrangement on the one hand and the cleaning station for the lower tool on the other.

The tool change frames are constructed such that they engage at least in part below the lower tool, i.e., they carry same for its rotation in and out of the shooting arrangement. For placing the lower tool on the tool change frames, same could be provided with special support means, which are made, for example, in the form of pins. These support pins could be provided on two opposite sides of the lower tool, so that the lower tool is placed or deposited on the tool change frame.

With respect to the rotatability of the tool change mechanism, same could be rotated by as much as 180°. This rotation would have to occur as a forward and backward movement. Likewise however, it would be possible to enable the rotation of the tool change frame in only one direction. In this instance, the rotatability would have to be by 360°, i.e., endless.

Furthermore, the tool change frame could also be made for a totally horizontal movement, so that the lower tools can be raised and lowered at the same time. In a simplest configuration, however, the tool change frame would be rotatable only in a predetermined horizontal plane.

Furthermore, it will be of advantage, when in a shooting arrangement the tool change frame can be positioned above a lifting table serving to raise the lower tool, or to press same against the thereabove arranged upper tool, and to lower the lower tool. Consequently, it would be possible to rotate the lower tool into the shooting arrangement, where it would be engaged by an upward movable lifting table and be raised from the tool change frame. The tool change frame could remain in its position, since the lifting table can operate between, or extend through the frame members.

Likewise, it would be of advantage, if a suction device were associated with the first lifting table, so as to remove in part by suction sand particles which drop upon opening the tools, as well as to clean the lower tool after placing it on the tool change frame.

Outside the shooting arrangement, the tool change mechanism or the tool change frame can be positioned above a second lifting table. In this instance, same may be a further work station outside of the shooting arrangement. In a further advantageous manner, both tool change frames could be arranged relative to one another such that they can be positioned at the same time above the two lifting tables, thus permitting simultaneously an operation at both lifting tables.

Advantageously, the second lifting table located outside of the core shooting arrangement is provided with a device for ejecting the cores from the moved-out lower tool. This ejection device operates between the frame members of the tool change frame and, therefore, is in no way obstructed by any tools or utensils. A device for cleaning the lower tool could be provided in the region of the second lifting table or even be associated with the lifting table. Corresponding manipulators could easily be provided, for example, above the second lifting table, it being likewise possible to handle any loose parts by means of the manipulators.

Finally, it is especially advantageous, when the cycle time in the shooting arrangement corresponds at least largely to the operating time at the second lifting table outside of the shooting arrangement. Thus, contrary to a removal in the region of the shooting arrangement, it would be possible to achieve twice the amount of production.

There exist various possibilities of perfecting and further developing the teaching of the present invention. To this end, reference may be made to the following description of an embodiment of the invention with reference to the drawing. In conjunction with the description of a preferred embodiment of the invention with reference to the drawing, also generally preferred embodiments and further developments of the teaching are described.

BRIEF DESCRIPTION OF THE DRAWINGS

The only FIGURE is a schematic side view of an embodiment of an apparatus in accordance with the invention for shooting foundry cores or molds.

DETAILED DESCRIPTION OF THE PREFERRED EMBODIMENT

As shown in the only FIGURE, a support frame 1*a* which mounts a shooting arrangement 1 comprises as essential components a shooting head 2 with a shooting plate 4 accommodating shooting nozzles 3 with feed hoppers 5 arranged thereabove. The core sand is shot into a bipartite tool, which has an upper tool 6 and a lower tool 7. A tool change mechanism 8 comprises two tool change frames 9, which are rotatable about a vertical axis 10. Each of the tool change frames 9 is adapted for alternate rotation into and out of the shooting arrangement 1.

In accordance with the invention, the tool change frame 9 rotated into the shooting arrangement serves to receive the lower tool 7 carrying cores 11. The lower tool 7 carrying cores 11 can be rotated out of shooting arrangement 1 at the same time as the other tool change frame 9 with a preferably cleaned lower tool 7 is rotated into the shooting arrangement 1. As a result, both tool change frames 9 are moved in and out simultaneously.

As further shown in the only FIGURE, the tool change frames 9 are arranged on diametrically opposed arms 12 extending from both sides of the axis of rotation 10. As can further be noted, the tool change frames 9 engage in part below the lower tool 7, namely below supporting pins 13 serving to place the lower tool on tool change frame 9. These supporting pins 13 are formed on two opposite sides of the lower tool 7, there being shown only one side thereof.

Furthermore, it is essential that the tool change mechanism 8 be rotatable in the selected embodiment by 180° in a horizontal plane.

Furthermore, in the selected embodiment it is essential that, in the shooting arrangement 1, the tool change frame 9 be positionable above a lifting table 14 serving both to raise the lower tool 7 and to press same against the thereabove arranged upper tool 6, and to lower the lower tool 7. This lifting table 14 is equipped with a suction device.

Outside the shooting arrangement 1, the tool change frame 9 can be positioned above a second lifting table 15. In the selected embodiment, both tool change frames 9 are arranged relative to one another, so that they can be positioned simultaneously above the two lifting tables 14, 15.

When viewed alone, the second lifting table 15 forms a further operating station, i.e., it is provided with a device for ejecting cores 11 from lower tool 7. The ejecting device comprises two piston assemblies, each including a cylinder 16, which is located under the two cores 11. Furthermore, a device not shown in the only FIGURE for cleaning the lower tool 7 is provided in the region of second lifting table 15.

Finally, it should be expressly stated that the cycle time in shooting arrangement 1 corresponds to the operating time at the second lifting table 15 outside of shooting arrangement 1, so that the production of cores 11 is optimally laid out.

We claim:

1. An apparatus for molding foundry cores comprising a support frame, a shooting head mounted on said support frame, an upper tool mounted on said support frame below said shooting head, lower tool, a tool change mechanism for supporting said lower tool and moving the same between an operative position located below said upper tool and a withdrawn position, said tool change mechanism being rotatable about a vertical axis and including two tool change frames, with each of said tool change frames being configured to support said lower tool thereupon such that the lower tool may be lifted therefrom, a lifting table mounted to said support frame below said operative position of said tool change mechanism and configured for lifting the lower tool from the mechanism and moving the same upwarding against the upper tool to form a mold which may then be filled by said shooting head, and such that when the lifting table is lowered the lower tool and the resulting molded core are separated from the upper tool and the lower tool is repositioned upon said mechanism, and the mechanism is then able to move the lower tool and molded core to said withdrawn position where the molded core may be removed from the lower tool.

2. The molding apparatus as defined in claim 1 wherein said two tool change frames are diametrically opposed to each other, and whereby the two tool change frames may be alternately moved horizontally between said operative and withdrawn positions upon rotation of said tool change mechanism about said vertical axis.

3. The molding apparatus as defined in claim 2 wherein said lower tool includes support pins on opposite sides thereof, and each of said tool change frames includes a support for engaging the underside of the support pins.

4. The molding apparatus as defined in claim 1 wherein said tool change mechanism is rotatable about said vertical axis by at least 180° degrees.

5. The molding apparatus as defined in claim 1 wherein said tool change mechanism is endlessly rotatable about said vertical axis.

6. The molding apparatus as defined in claim 1 further comprising a second lifting table positioned below said withdrawn position and so as to be able to lift the lower tool from its associated tool change frame.

7. The molding apparatus as defined in claim 1 further comprising a second lifting table positioned below said withdrawn position and wherein the second lifting table includes an ejector for ejecting a molded core upwardly from the lower tool.

* * * * *